United States Patent [19]

Kirjavainen et al.

[11] 4,063,997

[45] Dec. 20, 1977

[54] HYDRAULIC HEADBOX AND A GAS ENCLOSURE COMMUNICATING THEREWITH

[75] Inventors: Alvi Kirjavainen; Jouni Koskimies, both of Jyvaskyla, Finland

[73] Assignee: Valmet Oy, Finland

[21] Appl. No.: 659,238

[22] Filed: Feb. 19, 1976

[30] Foreign Application Priority Data

Feb. 25, 1975 Finland ..... 750541

[51] Int. Cl.[2] ..... D21F 1/02

[52] U.S. Cl. ..... 162/340; 162/343

[58] Field of Search ..... 162/340, 343, 344, 336, 162/216, 212, 337, 338

[56] References Cited

U.S. PATENT DOCUMENTS

| | | | |
|---|---|---|---|
| 2,934,142 | 4/1960 | Ikavalko | 162/337 |
| 2,973,034 | 2/1961 | White, Jr. | 162/343 X |
| 3,216,892 | 11/1965 | Wahlström et al. | 162/343 |
| 3,461,031 | 8/1969 | Reitzel | 162/340 X |
| 3,536,581 | 10/1970 | Wolf | 162/340 X |
| 3,853,697 | 12/1974 | Parker et al. | 162/340 X |
| 3,945,882 | 3/1976 | Egelhof et al. | 162/340 |

*Primary Examiner*—Richard V. Fisher

*Attorney, Agent, or Firm*—Steinberg & Blake

[57] ABSTRACT

A paper machine has an enclosure for containing a gas under pressure. A hydraulic headbox of the paper machine includes a slice as well as a conductor structure for conducting suspension to the slice and a distributor structure for distributing suspension as uniformly as possible to the conductor structure to be conducted thereby to the slice. The gas enclosure and distributor structure respectively have hollow interior portions communicating with each other so as to provide for the suspension in the distributor portion a free surface acted upon by gas under pressure in the enclosure so that this latter gas under pressure will act as a gas cushion for damping pressure variations in the stock suspension.

12 Claims, 10 Drawing Figures

HYDRAULIC HEADBOX AND A GAS ENCLOSURE COMMUNICATING THEREWITH

BACKGROUND OF THE INVENTION

The present invention relates to paper machines.

In particular, the present invention relates to hydraulic headboxes of paper machines and to devices for damping the pressure variation of stock suspension in a hydraulic headbox.

Thus, the present invention relates, in a paper machine, to a hydraulic headbox which has an inlet distributor by means of which the pulp suspension flow is distributed as uniformly as possible to a structure which conducts the pulp suspension to the slice of the headbox. This hydraulic headbox cooperates with a gas enclosure such as an air tank the purpose of which is to damp pressure variations which may occur from time to time in the pulp stock.

In general, known headboxes may be divided into three main catagories:

a. headboxes provided with air cushion constructed in immediate connection with the headbox, so as to provide so-called air-cushion headboxes,
b. hydraulic headboxes provided with an air cushion separate from the headbox itself and in which air tanks are located either in the feed-pipe system which feeds the pulp stock in advance of a distribution header, or the air tanks may be situated subsequent to the header, and
c. hydraulic headboxes which have no air cushion at all.

The use of an air cushion in connection with a headbox serves to attempt to equalize pressure variations which occur from time to time in the pulp stock flow prior to the outflow aperture or slice of the headbox. These variations may originate either in the pulp system prior to the headbox or they may be produced in the headbox itself. If such pressure variations are permitted to extend all the way to slice defined between the lips of the headbox, then the pressure variations will cause corresponding variations in the velocity of discharge of the stock jet from the headbox with the result that corresponding variations will occur in the base weight in the pulp web that is formed on the forming wire. Such variations in base weight, occurring longitudinally of the direction of travel of the web in the paper machine, cannot be equalized, at least in their entirety, during subsequent drying of the web, so that these variations will be apparent in the completed paper, thus detracting from the value thereof.

In order to obtain a uniform average flow velocity profile not only in the direction of web travel but also in the cross-machine direction, transversely of the direction of web travel, the inlet pipe of the headbox, or the so-called distribution header thereof, is very often tapered, having the configuration of a truncated cone, and providing for the pulp suspension a cross-section of flow which gradually diminishes from the inlet toward the outlet of the distributor header which is often provided at its outlet with a continuous bypass flow. From this tapered header which extends across the machine there depart at uniform intervals a relatively large number of so-called diffusor pipes which extend longitudinally of the machine and along which the stock flows from the header into the headbox. A geometry of the header which will achieve equal flow velocities and mass flow rates in each and every diffusor pipe can be mathematically calculated only as an approximation. Various defects in form are necessarily introduced into the geometry of the header during the manufacture of the headbox, and in addition because of pressure variations which occur during operation, these errors give rise to different flow velocities in different diffusor pipes, so that as a result there are unavoidable errors preventing achievement of a desired cross-machine velocity profile for the stock suspension flow.

In the first of the above-mentioned types of headboxes, namely the air-cushion headbox referred to under a) above, pressure variations which occur from time to time are usually damped in a highly efficient manner because in such headboxes the stock surface against which the air cushion acts has comparatively large area and the height of the stock space, measured at right angles to the direction of flow, is relatively small. A further advantage of such headboxes is that in general the air cushion extends quite close to the discharge slice or lip of the headbox, so that the opportunity for new pressure fluctuations to be generated in the region between the sphere of action of the air cushion and the discharge slice is minimal.

However, in spite of the above advantages of the air-cushion headbox, in recent times in the newest fast-operating paper machines, these air-cushion headboxes have quite often been replaced by hydraulic or fully hydraulic headboxes of the types (b) and (c) referred to above. The reason why these latter types of hydraulic headboxes have been used to a greater extent in recent times is that they have a greater ease of assembly particularly in connection with the relatively new twin-wire web-forming structures or so-called formers, and on the other hand these hydraulic types of headboxes have lower manufacturing costs. The higher turbulence of the stock jet discharging from the slice and its more favorable intensity distribution, as well as the resulting higher homogeneity of the stock, have also favored the introduction of these hydraulic headboxes.

However, the above advantages of hydraulic headboxes are opposed by certain difficulties encountered thereby, these difficulties being caused primarily by pressure variations in the stock as referred to above. As a result it has often been necessary after a hydraulic headbox has been provided to add to the headbox which originally was intended to operate as a fully hydraulic headbox, one or more separate air tanks which are intended to provide a substitute for the air cushion achieved in the conventional air-cushion type of headbox. Various structural designs are known with respect to the placement of such separate air tanks in connection with hydraulic headboxes. In some of these designs the air tanks are connected to the pulp stock pipe system in advance of the headbox, while in other constructions the air tanks are placed above the headbox itself and connected thereto by suitable connecting pipes or by way of a connecting duct communicating with the upper part of the headbox space. The above first type of construction according to which air tanks are connected to the hydraulic headbox system has the drawback that pressure variations produced before such a tank may perhaps be sufficiently damped but new fluctuations may arise in the region between the air tank and the lip slice of the headbox from various sources of disturbance, such as improper configuration of the distribution header, and these pressure variations now have access, without damping, to the lips at the slice of the headbox where the pressure variations will result in variations in the base weight of the paper as referred to above.

The second type of connection of the air tank to the hydraulic headbox also has an undesirable feature in that when the air tank is placed over the headbox the height of the free liquid level from the central axis of flow thereof is of necessity extremely great, or the connecting pipes or duct between the headbox and the air tank must be dimensioned so as to be relatively narrow as compared with the main flow passage. In both of these situations there is an impaired damping of the pressure fluctuations in the stock suspension as compared with the pressure variation damping capacity capable of being achieved by a conventional air-cushion type of headbox.

SUMMARY OF THE INVENTION

It is accordingly a primary object of the present invention to provide for paper machines hydraulic headboxes which are connected with gas enclosures in such a way that the above drawbacks are avoided.

Thus, it is an object of the present invention to bring about an efficient damping of pressure variations occurring in hydraulic headboxes by way of a gas enclosure such as an air tank which is situated and constructed in such a way that the above detrimental features of the separate air tanks are avoided while at the same time achieving damping characteristics which are as close as possible to the damping capacity of normal or conventional air-cushion types of headboxes.

In accordance with the invention the above drawbacks are eliminated and the desired objectives are attained primarily by a construction according to which an enclosure for gas under pressure, such as air, is connected with the inlet distributor means of the headbox, this latter means serving to distribute the stock suspension to a structure which conducts the stock suspension to the outlet slice of the headbox.

By way of the present invention the location of the damping action is situated close enough to the slice of the headbox so that with a headbox construction according to which the stock flow is not required to undergo a change of direction, or at least no abrupt change in direction, subsequent to the distribution header, there will be no source of new pressure variations subsequent to the distribution. Such changes of directions might possibly give rise to undesirable new pressure variations subsequent to the distribution header. According to a further feature of the invention the gas under pressure communicates with the distribution header in such a way that the area of the free surface of the pulp suspension directly acted upon by the gas cushion is relatively large while at the same time the height of this surface of the liquid suspension over the central axis of the main flow thereof is relatively small. Both of these factors improve the damping characteristics achieved from the gas cushion. Moreover, any errors in the cross-machine profile arising from an incorrect configuration of the distribution header can be effectively counteracted.

Thus, in accordance with the present invention there is a gas enclosure means for containing a gas such as air under pressure. A hydraulic headbox comprises a slice, a conducting means for conducting a pulp stock suspension to the slice, and a distributor means for distributing the pulp stock suspension to the conducting means as uniformly as possible to be conducted thereby to the slice of the hydraulic headbox. This distributor means of the hydraulic headbox cooperates with the gas enclosure means in such a way that gas under pressure therein will damp pressure variations which occur from time to time in the stock suspension.

BRIEF DESCRIPTION OF DRAWINGS

The invention is illustrated by way of example in the accompanying drawings which form part of this application and in which:

FIG. 3 is a longitudinal sectional elevation of another embodiment of the invention while

FIG. 5 is a vertical longitudinal section of a third embodiment of the invention while

FIG. 7 is a vertical longitudinal sectional elevation of a fourth embodiment of the invention while FIG. 9 is a vertical longitudinal sectional elevation of yet another embodiment of the invention while

DESCRIPTION OF PREFERRED EMBODIMENTS

Figure 1:
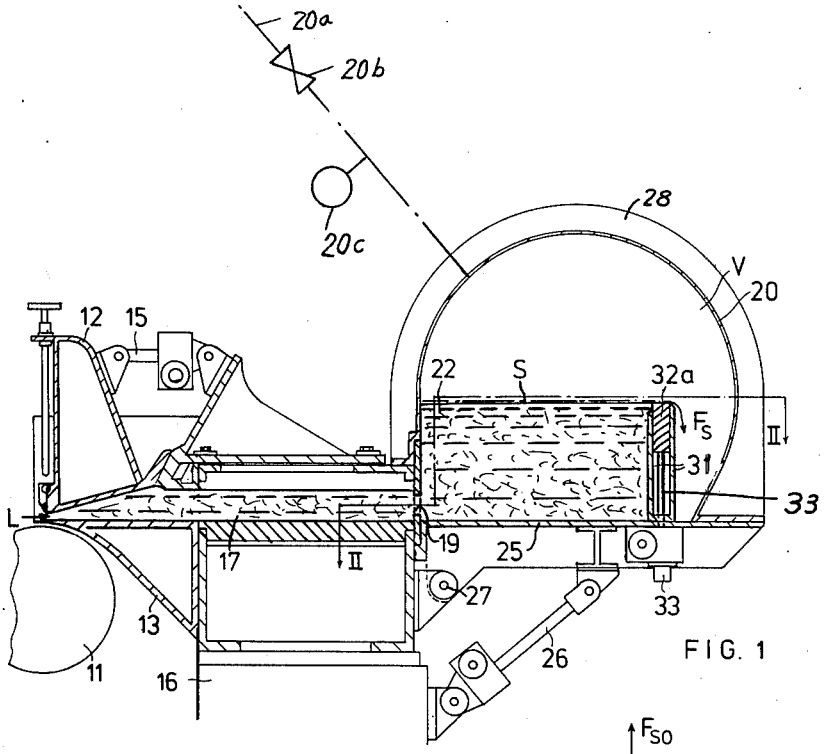
FIG. 1 is a schematic longitudinal sectional elevation of a combined hydraulic headbox and gas enclosure means of the invention, the section of FIG. 1 being taken in a plane which extends longitudinally of the machine in the direction in which the web travels during formation thereof.
Figure 2:
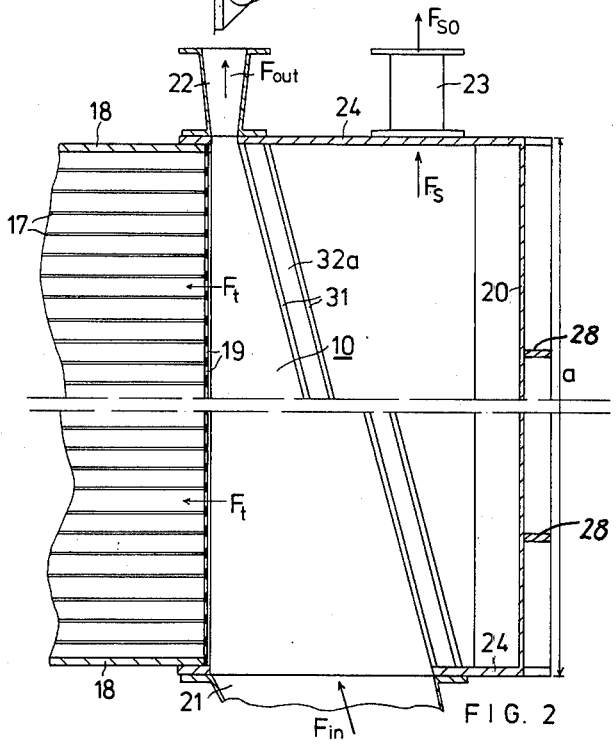
FIG. 2 is a fragmentary sectional plan view of the structure of FIG. 1 taken along II—II of FIG. 1 in the direction of the arrows.

Referring to FIGS. 1 and 2, the pulp stock suspension has a flow $F_{in}$ into the hydraulic headbox from the pulp stock system of the paper machine through various mixing and purifying means, this entering flow $F_{in}$ entering into the headbox by way of a pipe 21 situated at the inlet end of an elongated distributor means 10 which extends across the headbox transversely with respect to the direction of flow of the pulp suspension toward the slice of the headbox. The distributor means 10 tapers transversely across the machine so that the cross-section of flow of the suspension through the distributor means 10 gradually diminishes. The distributor means 10 has a front wall formed with apertures 19 through which the stock suspension flows from the distributor means 10 into a conducting means in the form of small channels defined between vertical lamellae 17 the interiors of which respectively communicate with the apertures 19 so that in this way from the pulp suspension in the distributor means 10 there is a flow $F_t$ longitudinally of the machine provided between the lamellae 17 of the conducting means and extending toward the outlet slice of the headbox. Instead of a conducting means formed by these lamellae 17 it is also possible to use a diffuser pipe system which is not illustrated.

To the rear of the front wall of the distributor means, which is formed with the apertures 19, the distributor means 10 has a rear wall in the form of a weir **32*a*. Part of the pulp stock in the distributor means 10 flows over the upper edge of the rear wall formed by the weir 32*a* so as to provide in this way a secondary stock flow $F_s$ which is received in a pipe 23 providing in this way a secondary flow passage forming the stock flow $F_{so}$. The front and rear walls of the distributor means 10 are interconnected by a bottom wall 25 so that the stock suspension is situated in the distributor means 10 on top of and above the bottom wall 25 thereof and between the front and rear walls with the surface of the stock suspension being open and unobstructed between the front and rear walls of the distributor means 10 with the weir 32***a* which forms the rear wall of the distributor means determining the elevation of the upper surface of the stock suspension.

The bottom wall 25 extends rearwardly beyond the rear weir wall 32*a* to a location where this bottom wall 25 is fixedly connected with a curved wall 20 which extends in a fluid tight manner upwardly from the bottom wall 25 and then around and over the distributor means 10 to form an extension of the front wall thereof where the apertures 19 are located. The opposed ends of the curved wall 20 are connected with side walls 24 so that these walls 24 together with the wall 20 and the part of the bottom wall 25 extending rearwardly from the weir 32*a* define a gas enclosure means for containing a gas, such as air under pressure. This gas enclosure means V may be provided with a gas such as air at a suitable pressure in any suitable way such as by way of the schematically indicated pipe 20*a* communicating with a source of gas under pressure. The gas is delivered to the enclosure means V through a valve 20*b*, and a suitable pressure gauge 20*c* is provided so that the operator can see the pressure prevailing in the enclosure means V. In this way the gas under pressure in the enclosure means V will act as a gas cushion directly on the relatively large upper exposed surface of the stock suspension situated between the front and rear walls and above the bottom wall of the distributor means 10. Thus this gas under pressure in the enclosure means V will act to damp pressure variations which occur from time to time in the flowing stock suspension. It is apparent, therefore, that the distributor means 10 and the gas enclosure means V respectively have hollow interior portions respectively containing the stock suspension and the gas under pressure in such a way that the latter gas will act as a cushion on the free surface of the stock suspension.

As is apparent from the construction illustrated in FIGS. 1 and 2, the inlet 21 is relatively wide and the rear wall formed by the weir 32*a* is inclined with respect to the front wall of the distributor means 10 in such a way that the distance of the weir 32*a* from the front wall is greater at the inlet end of the distributor means than at the opposed outlet end thereof formed by the outlet 22 providing a bypass flow $F_{out}$. Through this continuous reduction in the cross-section of the flow suspension across the machine through the distributor means 10 from the inlet 21 to the outlet 22 thereof it is possible to establish a pressure which is as constant as possible for the flow $F_t$ in the direction of web formation through the conducting means formed by the lamellae 17 toward the slice L. This pressure of the flow to the conducting means formed by the lamellae 17 will be maintained substantially constant across the entire width of the headbox. However it is impossible, primarily owing to manufacturing techniques, to achieve for the distributor means 10 a cross-sectional configuration which will yield a completely constant pressure if the entire suspension received by the distributor means were to be delivered to the conducting means 17, or to a diffuser pipe system. Therefore, the distributor means 10 is provided with the bypass outlet flow pipe 22 through which part of the stock flow may, without changing its direction, form the bypass flow $F_{out}$ which is returned to the pulp stock system. A similar effect is achieved by way of the secondary flow $F_s$ which flows over the weir 32*a*. The enclosure means V and the overflow weir 32*a* in combination provide an assurance that the same uniform pressure will prevail over the entire width of the headbox in the distributor means 10. The stock which flows over the weir 32*a*, as indicated at $F_s$, returns through the drainpipe 23 and a subsequent unillustrated water seal to the pulp stock system.

In the small longitudinally extending grooves or interstices defined between the lamellae 17, the stock flows in the direction of machine travel $F_t$ to the aperture provided by way of the slice L of the headbox. At the slice L the stock discharges in the form of a jet onto the forming wire which travels over the breast roll 11. FIG. 1 shows the lower lip beam 13 of the headbox as well as the upper lip beam 12 which can be adjusted by way of the adjusting means 15, so that in this way it is possible to regulate the size of the lip aperture which defines the slice L.

The entire headbox including its distributor means 10 is mounted on a suitable supporting stand 16. The structure which includes the gas enclosure means V as well as the distributor means 10 is supported on beams which extend in the operating direction, which is to say in the direction of web travel, with these beams supporting the bottom wall 25. A part of the bottom wall 25 forms the bottom wall of the distributor means 10 and is situated directly beneath and engaged by the stock suspension received by the distributor means 10. These latter parts are joined by way of a hinge structure 27 to the frame beam carried by the stand 16. Any suitable adjusting means 26 is provided to compensate for deflection of the bottom wall 25 or to adjust the latter so that if there is a deflection it will have a desired magnitude.

The conducting means formed by way of the lamellae 17 provides an exceedingly effective structure for conducting the stock suspension uniformly across the entire machine longitudinally to the slice L. The lamellae 17 are situated between opposed side walls 18 which are upright, and the opposed side walls 24 of the headbox form substantial extensions of the side walls 18 and in fact close off the interior of the enclosure means V situated beneath the curved wall 20 thereof, as pointed out above. Reinforcing ribs 28 are provided for the curved wall 20 as illustrated.

The rear wall or weir 32*a* of the distributor means 10 may, as shown in FIGS. 1 and 2, be constituted by a pair of parallel vertical walls 31 which define between themselves a space in which the elongated weir element 32*a* is vertically movable with suitable packings being provided between the weir element 32*a* and the wall 31 to achieve fluid-tightness and adjustability of the weir element 32*a*. The height of the latter is adjustable by way of at least a pair of screws 33 which are spaced from each other along the element 32*a* and which extend downwardly through the space between the vertical walls 31 and downwardly beyond the wall 25 to a location where the screws 33 are connected with an operating structure which simultaneously turns these screws in one direction or the other so as to raise or lower the upper edge of the weir 32*a*. Thus, the weir 32*a* will determine the elevation of the free surface S of the stock suspension in the distributor means 10. It will be noted that with this construction a comparatively extensive surface will be confronted by the gas cushion in the enclosure V, so as to achieve the results of the invention. It will be seen from FIG. 2 that the distributor means 10 has a dimension or length *a* extending across the entire width of the machine, this length being equal substantially to the dimension of the slice L and the dimension of the conducting means 17 transversely of the machine. The surface S of the stock suspension extends throughout this entire length *a* of the distributor means 10, or in other words over the entire width of the headbox.

Figure 3:
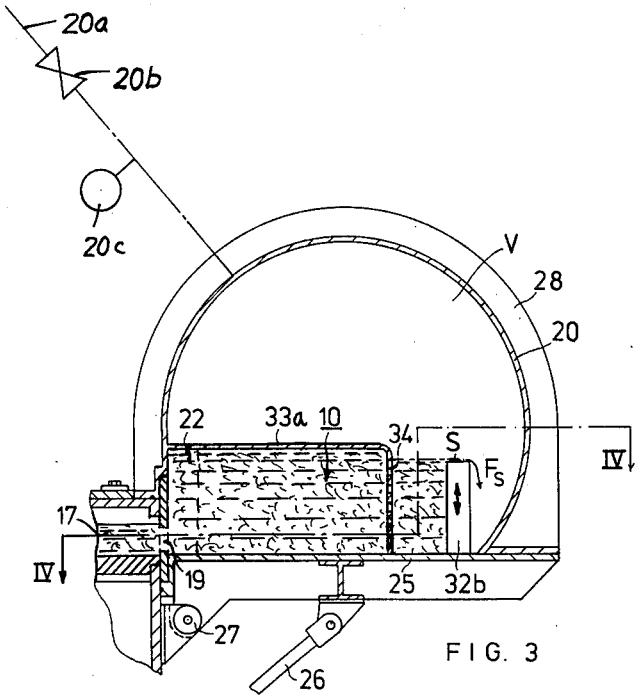
Figure 4:
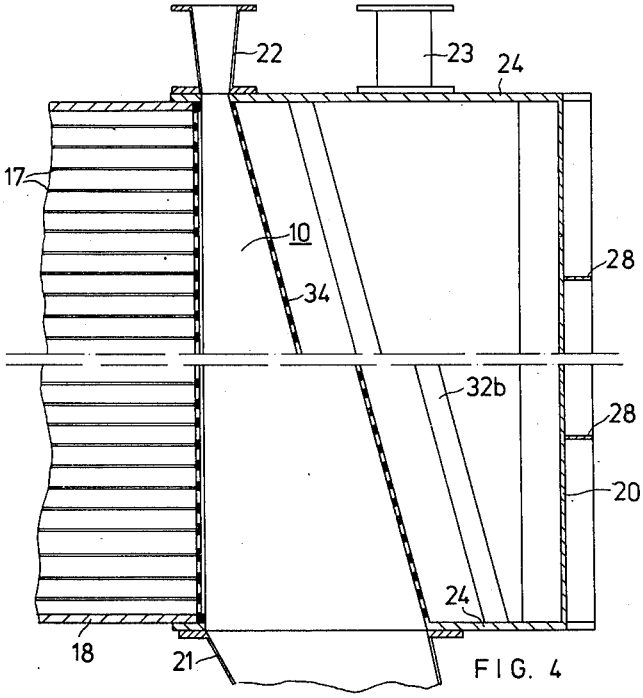
FIG. 4 is a fragmentary sectional plan view taken along line IV—IV of FIG. 3.

The embodiment of the invention which is illustrated in FIGS. 3 and 4 differs from that of FIGS. 1 and 2 in that between the rear wall formed by the weir 32*b*, which may correspond in all respects to the weir 32*a*, and the front wall which is provided with the apertures 19, the distributor means 10 has an intermediate wall 34 which is perforated so as to have a relatively large number of apertures passing therethrough. The intermediate wall 34 is parallel to the rear wall 32*b* and is fixed to and extends upwardly from the bottom wall 25. At its upper edge region the intermediate wall 34 is connected with a top wall 33*a* which extends from the intermediate wall 34 all the way up to the front wall of the distributor means 10 where the apertures 19 are situated. Thus, the suspension received by way of the inlet 21 is confined between the wall 25 and the upper wall 35*a* in the space between the intermediate wall 34 and the front wall, while this suspension can of course have access through the apertured intermediate wall 34 with the space between the latter and the rear wall 32*b* so that between the intermediate and rear walls the pulp suspension has an upper free surface exposed to the gas under pressure in the enclosure means V, so that in this way the embodiment of FIGS. 3 and 4 provides for damping by the gas cushion while at the same time the part of the suspension which is acted upon by the gas cushion is situated in a hollow interior portion of the distributor means which communicates with the hollow interior portion thereof between the intermediate wall 34 and the front wall by way the apertured plate or wall 34 which forms a flow-resistance means. Thus, in the case of FIGS. 3 and 4 part of the stock which is received in the distributor means flows not only toward the slice but also in the opposite direction toward the weir 32*b* over which the stock flows to be received by the pipe 23 in the manner described above, and of course the stock flows continuously to the outlet 22 from the inlet 21 as also described above. By way of adjusting the elevation of the upper edge of the weir 32*b*, in a manner described above in connection with FIG. 1, it is possible to determine the elevation of the surface of the suspension which is acted upon by the gas cushion. A uniform pressure profile in the longitudinal direction along the distributor means 10 from the inlet 21 to the outlet 22 is achieved by providing the intermediate wall 34 with a number of apertures large enough to provide for the area of the wall 34 occupied by the apertures approximately 50% of the total area of the wall 34. On the other hand, the outflow through the tube 23 is determined by adjusting the elevation of the upper edge of the weir 32*b*. It will be seen that the bracing ribs or flanges 28 for the gas enclosure means V are also indicated in FIGS. 3 and 4.

Figure 5:
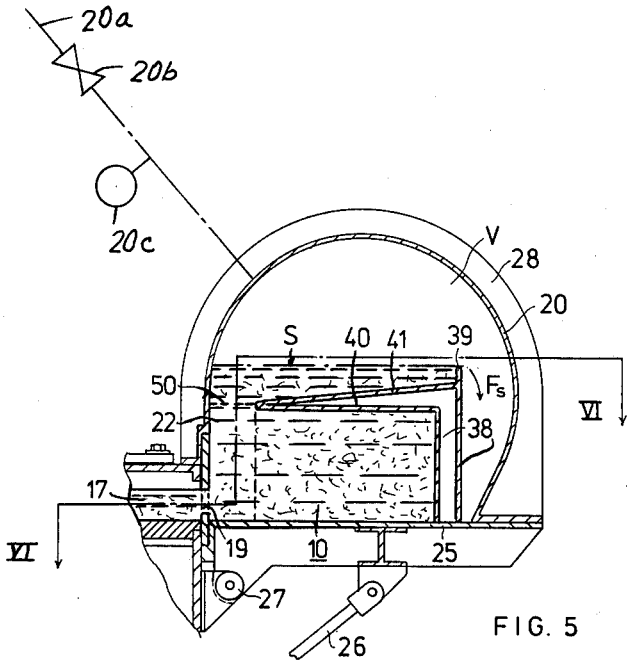
Figure 6:
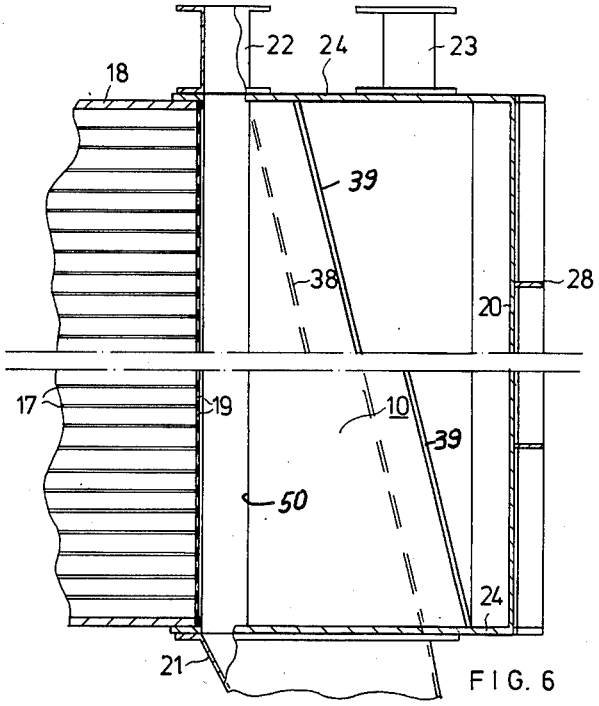
FIG. 6 is a fragmentary sectional plan view taken along line VI—VI of FIG. 5 in the direction of the arrows.

The embodiment of FIGS. 5 and 6 differs from that of FIGS. 1 and 2 in that in this embodiment there is an upper wall structure for the distributor means 10 extending forwardly from the inclined rear wall thereof. Thus, as may be seen from FIGS. 5 and 6, a pair of parallel walls 38 extend from the inlet to the outlet of the distributor means 10 with the inclination with respect to the front wall having the apertures 19 most clearly apparent from FIG. 6, so that in this case also the cross-section of flow gradually becomes smaller from the inlet to the outlet of the distributor means 10. However, the front wall 38 is fixed with a horizontal upper wall 40 extending over the wall 25 and extending toward but terminating short of the front wall provided with the apertures 19 so as to define with this front wall a longitudinal gap 50 of uniform width, as is apparent from FIG. 6 in particular. In other words the horizontal upper wall 40 of the distributor means 10 is of a substantially triangular configuration and has a front edge parallel to the front wall which is provided with the apertures 19. The pulp suspension from the inlet 21 flows into the space beneath the wall 40 and is partly confined between the latter and the wall 25 as well as between the front one of the pair of walls 38 and the wall provided with the apertures 19, and the resistance to flow of the suspension out of the space beneath the wall 40 is such that part of the suspension flows up through the gap 50. The rear one of the pair of walls 38 is fixed adjacent its upper edge 39 with a higher wall 41, which is higher than the upper wall 40 and which is inclined upwardly and rearwardly from the front edge of the wall 40 in the manner which is most clearly apparent from FIG. 5. Thus, as a result of this construction the pulp suspension will rise up to the elevation of the edge 39 over which the suspension flows to provide the secondary flow $F_s$ which discharges through the pipe 23 as described above. At the same time an exceedingly large surface area S is provided at the free surface of the pulp suspension to be acted upon by the gas cushion in the enclosure means V. Thus, with this embodiment the pressure of the gas on the free surface S of the suspension acts through the suspension on the part of the suspension which is in the distributor means 10 beneath the wall 40 thereof through the gap 50 the area of which is considerably smaller than the area of the free surface S. It will be seen that the width of the gap 50 is equal to the width of the area S only at the region of the outlet 22 but otherwise is substantially smaller than the width of the surface S. Thus, the edge 39 of the rear one of the pair of walls 38 acts as a weir to determine the elevation of the surface S and the secondary flow $F_s$ is produced as described above. Thus, the embodiment of FIGS. 5 and 6 provides a large area for the gas cushion to act on the pulp suspension while at the same time this cushioning or damping is transmitted to the body of the suspension in the distributor means 10 beneath the wall 40 thereof through the relatively narrow gap 50.

Figure 7:
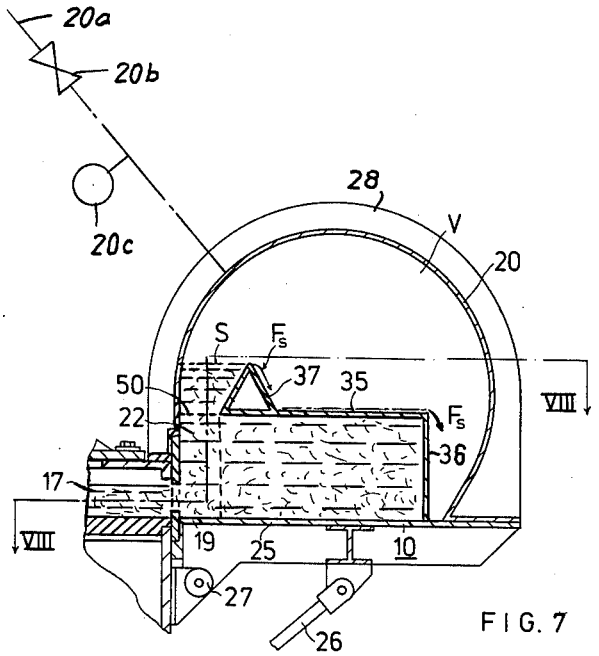
Figure 8:
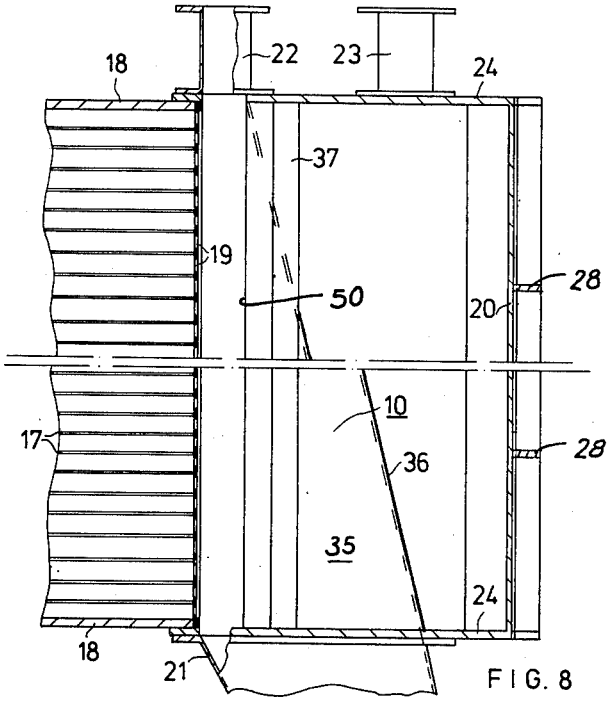
FIG. 8 is a sectional plan view taken along line VIII—VIII of FIG. 7 in the direction of the arrows.

According to the embodiment of the invention which is illustrated in FIGS. 7 and 8, the distributor means 10 has a rear wall 36 inclined with respect to the front wall provided with the apertures 19 in the manner most clearly apparent from FIG. 8, and in this case also the rear wall 36 is connected with an upper wall 35 which extends horizontally from the top edge of the rear wall 36 toward but terminates short of the wall provided with the apertures 19 while the front edge of the wall 35 is parallel to the front wall provided with the apertures 19 so as to define in this case also a gap 50 which may be identical with the gap 50 of FIGS. 5 and 6. However, in the case of FIGS. 7 and 8, there is a triangular wall structure 37 which includes a front upwardly and rearwardly inclined wall extending from the front edge of the wall 35 and a rear downwardly inclined wall providing the cross-sectional triangular configuration for the wall structure 37 as illustrated in FIG. 7. In this way also the pulp suspension can rise up through the gap 50 to provide above the latter the enlarged surface area S against which the gas cushion acts while at the same time the upper edge of the wall structure 37 acts as a weir to provide the secondary flow $F_s$ determining the elevation of the surface S of the pulp suspension. In this case also it will be seen that while the gas cushion acts on the suspension through an area larger than that of the gap 50, through this gap 50 the gas cushion acts on the body of the suspension situated in the distributor means 10 beneath the upper wall 35 thereof. The secondary flow $F_s$ flows down the wall structure 37 from the top edge thereof and along the upper wall 35 to discharge out through the pipe 23 as described above. Thus it will be seen that the secondary flow flows from the top surface of the top wall 35 downwardly along the rear wall 36 to discharge out through the pipe 23.

Figure 9:
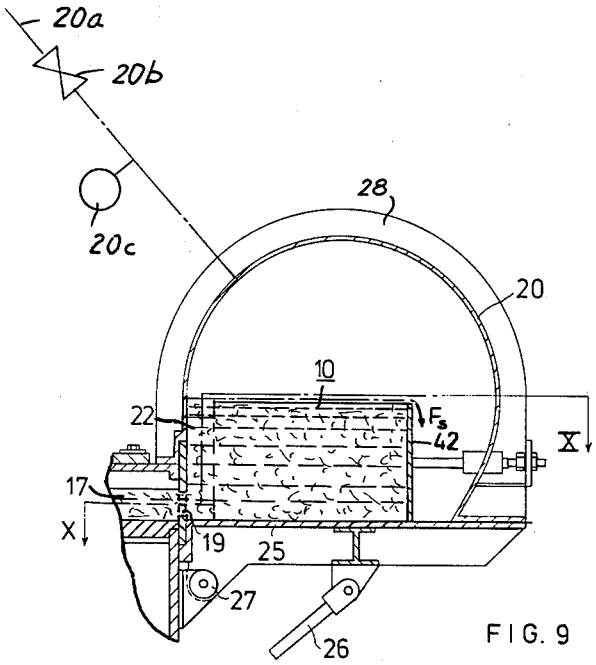
Figure 10:
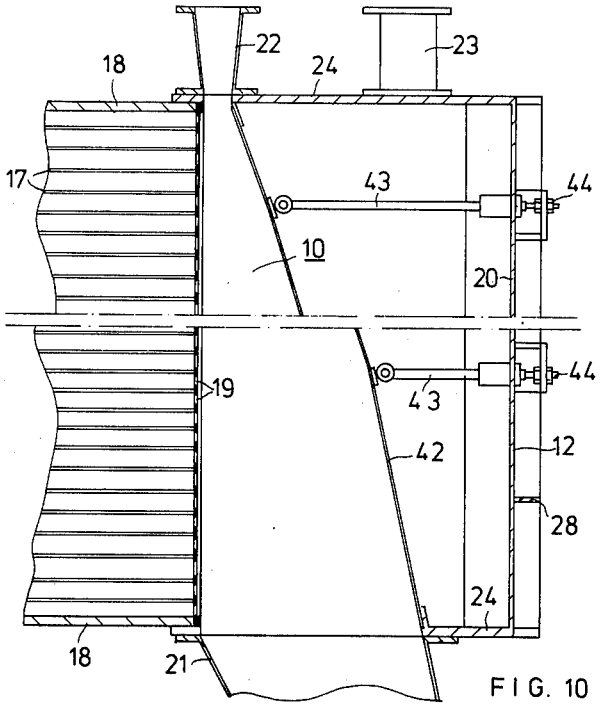
FIG. 10 is a fragmentary sectional plan view taken along line X—X of FIG. 9 in the direction of the arrows.

The embodiment of the invention which is illustrated in FIGS. 9 and 10 is very similar to that of FIGS. 1 and 2 in that in this case also the distributor means 10 is completely open above the bottom wall 25 thereof. In this case, however, the rear inclined wall 42, which also acts as a weir, is flexible while having a fluid-tight connection with the bottom wall 25. Thus the substantially vertical flexible rear wall 42 of the distributor means 10 has a top edge acting as a weir to provide a secondary flow $F_s$. At the same time, because of its flexibility it is possible to adjust the configuration of the wall 42. For this purpose elongated threaded members 43 are fixed to the wall 42 at spaced locations therealong and are connected to adjusting structures 44 which can be turned for displacing elements 43 to the right or left, as viewed in FIG. 10, so that in this way it is possible to adjust the configuration of the wall 42 which lends itself to this adjustment because of the flexibility of this wall 42. By way of the rotary screw means 44 and the elongated arms 43 it is thus possible to change the shape of the wall 42 so as to equalize the longitudinal pressure distribution in the distributor means 10 along the latter from the inlet 21 to the outlet 22. Of course, in addition to adjusting the wall 42 so as to equalize the longitudinal pressure distribution it is also possible to adjust the wall 42 in order to provide any desired adjustment in the pressure distribution. Thus with the embodiment of FIGS. 9 and 10 it is possible to achieve a very precise longitudinal pressure distribution along the distributor means 10 while at the same time providing a large surface area for the suspension to be acted upon by the gas cushion with the elevation of the surface of the suspension being determined by the top edge of the wall 42.

What is claimed is:

1. For use in a paper machine, enclosure means for containing a gas under pressure, and a hydraulic headbox comprising a slice, conducting means for conducting a pulp stock suspension to said slice, and distributor means for receiving the pulp stock suspension and distributing the same as uniformly as possible to said conducting means to be conducted thereby to said slice, said distributor means having a bottom wall situated directly beneath and engaged by the stock suspension received by said distributor means, said distributor means of said hydraulic headbox and said enclosure means each having hollow interior portions with said pulp stock suspension being situated in said hollow interior portion of said distributor means on said bottom wall thereof while said gas under pressure is situated in said hollow interior portion of said enclosure means, and both of said hollow interior portions communicating with each other so that the pulp stock suspension on is acted upon by the gas under pressure for the purpose of damping pressure variations in the stock suspension, said distributor means providing for said suspension a relatively large free surface area exposed to the gas in the hollow interior portion of said enclosure means so that the latter gas forms a gas cushion acting against the free surface of said suspension, said slice and said conducting means having a given dimension extending transversely of the direction of flow of the suspension toward said slice, and said distributor means having transversely of said direction of flow a length substantially equal to said dimension, and said distributor means providing for said suspension at said free surface thereof a dimension transversely of said direction of flow also equal to the length of said distributor means, said distributor means having a front wall through which said distributor means communicates with said conducting means, a rear wall situated rearwardly of said front wall, and said bottom wall extending between said front and rear walls, said distributor means being open between said front and rear wall and above said bottom wall and containing the stock suspension between said front and rear walls and above said bottom wall so that said stock suspension has at its free surface which is acted upon by the gas cushion an area substantially equal to that of said bottom wall of said distributor means.

2. For use in a paper machine, enclosure means for containing a gas under pressure, and a hydraulic headbox comprising a slice, conducting means for conducting a pulp stock suspension to said slice, and distributor means for receiving the pulp stock suspension and distributing the same as uniformly as possible to said conducting means to be conducted thereby to said slice, said distributor means having a bottom wall situated directly beneath and engaged by the stock suspension received by said distributor means, said distributor means of said hydraulic headbox and said enclosure means each having hollow interior portions with said pulp stock suspension being situated in said hollow interior portion of said distributor means on said bottom wall thereof while said gas under pressure is situated in said hollow interior portion of said enclosure means, and both of said hollow interior portions communicating with each other so that the pulp stock suspension is acted upon by the gas under pressure for the purpose of damping pressure variations in the stock suspension, said distributor means providing for said suspension a relatively large free surface area exposed to the gas in the hollow interior portion of said enclosure means so that the latter gas forms a gas cushion acting against the free surface of said suspension, said slice and said conducting means having a given dimension extending transversely of the direction of flow of the suspension toward said slice, and said distributor means having transversely of said direction of flow a length substantially equal to said dimension, and said distributor means providing for said suspension of said free surface thereof a dimension transversely of said direction of flow also equal to the length of said distributor means, said distributor means including a front wall through which the stock suspension flows to said conducting means, a rear wall situated rearwardly of said front wall and said bottom wall interconnecting said front and rear walls to define therewith at least part of the hollow interior of said distributor means in which the stock suspension is situated, said distributor means having an upper wall extending forwardly from an upper edge region of said rear wall toward but terminating short of said front wall to define therewith a gap extending along the entire length of said distributor means, and said distributor means including a wall higher than said upper wall connected to and extending upwardly from said upper wall and said higher wall having spaced upwardly beyond said upper wall of said distributor means a portion situated more distant from said front wall than a front edge region of said upper wall which defines part of said gap, and said distributor means providing for the stock suspension a space which extends upwardly through said gap into the space between said front wall and said portion of said higher wall, whereby the area of the free surface of the suspension against which the gas cushion acts is higher than said gap and of an area larger than said gap.

3. For use in a paper machine, enclosure means for containing a gas under pressure, and a hydraulic headbox comprising a slice, conducting means for conducting a pulp stock suspension to said slice, and distributor means for receiving the pulp stock suspension and distributing the same as uniformly as possible to said conducting means to be conducted thereby to said slice, said distributor means having a bottom wall situated directly beneath and engaged by the stock suspension received by said distributor means, said distributor means of said hydraulic headbox and said enclosure means each having hollow interior portions with said pulp stock suspension being situated in said hollow interior portion of said distributor means on said bottom wall thereof while said gas under pressure is situated in said hollow interior portion of said inclosure means, and both of said hollow interior portions communicating with each other so that the pulp stock suspension is acted upon by the gas under pressure for the purpose of damping pressure variations in the stock suspension, said distributor means providing for said suspension a relatively large free surface area exposed to the gas in the hollow interior portion of said enclosure means so that the latter gas forms a gas cushion acting against the free surface of said suspension, said slice and said conducting means having a given dimension extending transversely of the direction of flow of the suspension toward said slice, and said distributor means having transversely of said direction of flow a length substantially equal to said dimension, and said distributor means providing for said suspension at said free surface thereof a dimension transversely of said direction of flow also equal to the length of said distributor means, said distributor means having a second hollow interior portion communicating with said conducting means and including a flow resistance means which provides communication between both of said hollow interior portions of said distributor means so that the part of the stock suspension whose surface is acted upon by the gas cushion communicates with the second hollow interior portion of said distributor means only through said flow-resistance means.

4. The combination of claim 3 and wherein said flow-resistance means is in the form of an apertured plate situated between and separating said pair of hollow interior portions of said distributor means.

5. The combination of claim 4 and wherein said distributor means includes a front wall through which said distributor means communicates with said conducting means, a rear wall situated to the rear of said front wall, said bottom wall interconnecting said front and rear walls, and an intermediate apertured wall situated between said front and rear walls and forming said flow-resistance means, said distributor means including a top wall extending from an upper edge region of said intermediate wall toward and connected to said front wall.

6. For use in a paper machine, enclosure means for containing a gas under pressure, and a hydraulic headbox comprising a slice, conducting means for conducting a pulp stock suspension to said slice, and distributor means for receiving the pulp stock suspension and distributing the same as uniformly as possible to said conducting means to be conducted thereby to said slice, said distributor means having a bottom wall situated directly beneath and engaged by the stock suspension received by said distributor means, said distributor means of said hydraulic headbox and said enclosure means each having hollow interior portions with said pulp stock suspension being situated in said hollow interior portion of said distributor means on said bottom wall thereof while said gas under pressure is situated in said hollow interior portion of said enclosure means, and both of said hollow interior portions communicating with each other so that the pulp stock suspension is acted upon by the gas under pressure for the purpose of damping pressure variations in the stock suspension, said distributor means providing for said suspension a relatively large free surface area exposed to the gas in the hollow interior portion of said enclosure means so that the latter gas forms a gas cushion acting against the free surface of said suspension, said slice and said conducting means having a given dimension extending transversely of the direction of flow of the suspension toward said slice, and said distributor means having transversely of said direction of flow a length substantially equal to said dimension, and said distributor means providing for said suspension at said free surface thereof a dimension transversely of said direction of flow also equal to the length of said distributor means, said distributor means including a front wall through which the interior of said distributor means communicates with said conducting means, a rear wall situated to the rear of said front wall and said bottom wall extending between said front and rear walls, said distributor means being open between said front and rear walls and above said bottom wall thereof to provide for the suspension in said distributor means the free surface against which the gas cushion acts, and said rear wall having a top edge region over which the suspension flows so that said top edge region of said rear wall forms a weir means for determining the elevation of the surface of the suspension against which the gas cushion acts.

7. For use in a paper machine, enclosure means for containing a gas under pressure, and a hydraulic headbox comprising a slice, conducting means for conducting a pulp stock suspension to said slice, and distributor means for receiving the pulp stock suspension and distributing the same as uniformly as possible to said conducting means to be conducted thereby to said slice, said distributor means of said hydraulic headbox and said enclosure means each having hollow interior portions with said pulp stock suspension being situated in said hollow interior portion of said distributor means while said gas under pressure is situated in said hollow interior portion of said enclosure means, and both of said hollow interior portions communicating with each other so that the pulp stock suspension is acted upon by the gas under pressure for the purpose of damping pressure variations in the stock suspension, said distributor means providing for said suspension a relatively large free surface area exposed to the gas in the hollow interior portion of said enclosure means so that the latter gas forms a gas cushion acting against the free surface of said suspension, said slice and said conducting means having a given dimension extending transversely of the direction of flow of the suspension toward said slice, and said distributor means having transversely of said direction of flow a length substantially equal to said dimension, and said distributor means providing for said suspension at said free surface thereof a dimension transversely of said direction of flow also equal to the length of said distributor means, said distributor means including a front wall through which the interior of said distributor means communicates with said conducting means, a rear wall situated to the rear of said front wall and a bottom wall extending between said front and rear walls, said distributor means being open between said front and rear walls and above said bottom wall thereof to provide for the suspension in said distributor means the free surface against which the gas cushion acts, and said rear wall having a top edge region over which the suspension flows so that said top edge region of said rear wall forms a weir means for determining the elevation of the surface of the suspension against which the gas cushion acts, an adjusting means being operatively connected with said rear wall for adjusting the elevation of the upper edge region thereof so as to determine the height of said wier means and thus the height of the surface of the suspension against which the gas cushion acts.

8. For use in a paper machine, enclosure means for containing a gas under pressure, and a hydraulic headbox comprising a slice, conducting means for conducting a pulp stock suspension to said slice, and distributor means for receiving the pulp stock suspension and distributing the same as uniformly as possible to said conducting means to be conducted thereby to said slice, said distributor means of said hydraulic headbox and said enclosure means each having hollow interior portions with said pulp stock suspension being situated in said hollow interior portion of said distributor means while said gas under pressure is situated in said hollow interior portion of said enclosure means, and both of said hollow interior portions communicating with each other so that the pulp stock suspension is acted upon by the gas under pressure for the purpose of damping pressure variations in the stock suspension, said distributor means providing for said suspension a relatively large free surface area exposed to the gas in the hollow interior portion of said enclosure means so that the latter gas forms a gas cushion acting against the free surface of said suspension, said slice and said conducting means having a given dimension extending transversely of the direction of flow of the suspension toward said slice, and said distributor means having transversely of said direction of flow a length substantially equal to said dimension, and said distributor means providing for said suspension at said free surface thereof a dimension transversely of said direction of flow also equal to the length of said distributor means, said distributing means including a front wall through which the interior of said distributor means communicates with said conducting means, a rear wall situated to the rear of said front wall and a bottom wall extending between said front and rear walls, said distributor means being open between said front and rear walls and above said bottom wall thereof to provide for the suspension in said distributor means the free surface against which the gas cushion acts, and said rear wall having a top edge region over which the suspension flows so that said top edge region of said rear wall forms a weir means for determining the elevation of the surface of the suspension against which the gas cushion acts, an adjusting means being operatively connected with said rear wall for adjusting the position thereof with respect to said front wall for determining the cross-section of flow of the suspension along said distributor means between said front and rear walls thereof.

9. For use in a paper machine, enclosure means for containing a gas under pressure, and a hydraulic headbox comprising a slice, conducting means for conducting a pulp stock suspension to said slice, and distributor means for receiving the pulp stock suspension and distributing the same as uniformly as possible to said conducting means to be conducted thereby to said slice, said distributor means of said hydraulic headbox and said enclosure means each having hollow interior portions with said pulp stock suspension being situated in said hollow interior portion of said distributor means while said gas under pressure is situated in said hollow interior portion of said enclosure means, and both of said hollow interior portions communicating with each other so that the pulp stock suspension is acted upon by the gas under pressure for the purpose of damping pressure variations in the stock suspension, said conducting means having opposed side walls between which the suspension flows toward said slice, said distributor means having next to one of said opposed side walls a relatively wide inlet end and next to the other of said opposed side walls a relatively narrow outlet end, said distributor means having a front wall through which the suspension flows from said distributor means to said conducting means and a rear wall situated to the rear of said front wall and extending from said inlet to said outlet end of said distributor means, said rear wall being inclined with respect to said front wall and being situated at a greater distance from said front wall at said inlet end than at said outlet end so that the cross section of the flow of the suspension through said distributor means gradually diminishes from said inlet toward said outlet end of said distributor means.

10. The combination of claim 9 and wherein said distributor means has a hollow interior between said front and rear walls which is completely open and communicates with the interior of said enclosure means, the suspension in said distributor means flowing not only from said inlet end to said outlet end of said distributor means but also flowing over an upper edge of said rear wall.

11. The combination of claim 9 and wherein said distributor means has a top wall extending forwardly from said rear wall up to but terminating short of said front wall to define a gap therewith and said distributor means including above said top wall a wall inclined upwardly and rearwardly from a front edge of said top wall to define with said front wall a space also occupied by said suspension and providing for the suspension a free surface acted upon by the gas under pressure in said enclosure means whereby the area of said free surface is greater than the area of said gap.

12. The combination of claim 9 and wherein said distributor means includes an intermediate wall situated between said front and rear walls and extending parallel to said rear wall, said intermediate wall being formed with apertures passing therethrough to form a flow-resistance means providing communication between stock suspension situated on opposite sides of said intermediate wall between said front and rear walls, and said distributor means having a top wall extending forwardly from said intermediate wall to said front wall, the suspension flowing to said outlet end of said distributor means only from the space between said intermediate wall and front wall while the suspension between said intermediate wall and rear wall flows over an upper edge of said rear wall with the space between said intermediate wall and rear wall communicating with the gas in said enclosure means.

* * * * *